US010072424B2

(12) United States Patent
Fouratt et al.

(10) Patent No.: US 10,072,424 B2
(45) **Date of Patent: *Sep. 11, 2018**

(54) BUILDING-MOUNTED AWNING WITH SINGLE LOCATION ATTACHMENT

(71) Applicant: Glen Raven, Inc., Glen Raven, NC (US)

(72) Inventors: Daniel G. Fouratt, Chapel Hill, NC (US); Jonathan S. Colton, Sandy Springs, GA (US)

(73) Assignee: Glen Raven, Inc., Glen Raven, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/403,574

(22) Filed: Jan. 11, 2017

(65) Prior Publication Data

US 2017/0121981 A1 May 4, 2017

Related U.S. Application Data

(63) Continuation of application No. 14/856,900, filed on Sep. 17, 2015, now Pat. No. 9,551,154.

(51) Int. Cl.
*E04F 10/00* (2006.01)

(52) U.S. Cl.
CPC ..... *E04F 10/00* (2013.01)

(58) Field of Classification Search
CPC ..... E04F 10/00; E04F 10/04; E04F 10/0662; E04H 15/08; E04H 15/58
USPC ..... 248/534, 535, 538; 211/87.01
See application file for complete search history.

(56) References Cited

U.S. PATENT DOCUMENTS

| | | | | |
|---|---|---|---|---|
| 1,377,784 A | | 5/1921 | Nodland | |
| 1,785,809 A | | 12/1930 | Davis | |
| 1,934,600 A | * | 11/1933 | Fretz | B68C 1/002 248/200 |
| 1,956,850 A | | 5/1934 | Edward | |
| 2,234,760 A | | 3/1941 | Guarcello | |
| 2,235,927 A | | 3/1941 | Handley | |
| 2,559,209 A | | 7/1951 | Alderfer | |
| 2,720,885 A | | 10/1955 | Carl | |
| 2,848,117 A | * | 8/1958 | Miller | E04G 5/06 211/107 |
| 2,848,765 A | | 8/1958 | Showalter | |

(Continued)

FOREIGN PATENT DOCUMENTS

GB 2247832 A * 3/1992 ..... D06F 57/12

OTHER PUBLICATIONS

BreezeFree, Fan-Awnings, https://www.specifiedby.com/breezefree/fan-awnings, known at least as early as Sep. 16, 2015, last viewed Dec. 11, 2015, 6 pgs.

(Continued)

*Primary Examiner* — Brent W Herring
(74) *Attorney, Agent, or Firm* — Womble Bond Dickinson (US) LLP

(57) ABSTRACT

A building-mounted awning. The awning includes a support frame, and a covering provided over the support frame to act as shelter from precipitation, or act as a shade from the sun. The support frame is attached to the building at only one location along a width of the support frame by a single bracket attached to the building.

20 Claims, 4 Drawing Sheets

(56) References Cited

U.S. PATENT DOCUMENTS 3,013,644 A * 12/1961 Smith ..... E04B 9/32 52/506.08
3,234,697 A 2/1966 Toti
3,299,570 A 1/1967 Radcliffe
4,151,971 A * 5/1979 Daly ..... F16M 13/02 248/201
4,184,295 A 1/1980 Hicks
4,198,998 A 4/1980 Duffy
4,309,981 A 1/1982 Briggs
4,393,629 A 7/1983 Gasparini
5,148,848 A 9/1992 Murray
5,170,811 A 12/1992 Kirk
5,390,719 A 2/1995 Barnes
5,660,286 A * 8/1997 Shea ..... A47F 5/08 211/189
RE35,731 E * 2/1998 Lach ..... F16M 13/02 248/512
5,845,886 A * 12/1998 McCormick ..... F04D 25/088 248/200.1
5,860,440 A 1/1999 Murray
6,167,897 B1 1/2001 Resso
6,267,130 B1 7/2001 Konda
D448,717 S * 10/2001 Hanson ..... D12/162
6,363,664 B1 * 4/2002 Brutsaert ..... E04F 10/0618 135/117
6,467,745 B1 * 10/2002 Sickels ..... F16M 11/10 248/235
6,591,556 B2 7/2003 Bertheaume
6,726,170 B2 * 4/2004 Luo ..... G09F 17/00 248/520
6,742,757 B2 * 6/2004 Fox ..... G09F 17/00 248/535
6,811,132 B1 * 11/2004 Ferdinand ..... F16M 13/02 116/173
6,829,854 B2 12/2004 Reynolds
6,957,679 B2 10/2005 Powell
7,410,135 B1 * 8/2008 Dibble ..... F42B 4/00 102/358
7,568,491 B2 8/2009 Banfill et al.
7,900,386 B2 * 3/2011 Zheng ..... G09F 15/00 40/603
D639,206 S * 6/2011 Lach ..... G09F 17/00 D11/182
7,967,050 B2 6/2011 Gutierrez
8,104,527 B1 1/2012 Konda
8,132,583 B2 3/2012 Mowatt
8,359,678 B1 * 1/2013 Burdette ..... E03D 11/143 4/252.2
8,458,964 B2 6/2013 Lamotte
9,187,922 B1 11/2015 Phillips
2003/0098403 A1 * 5/2003 Fox ..... G09F 17/00 248/538
2004/0177565 A1 9/2004 Wesdock
2004/0244249 A1 * 12/2004 Zheng ..... G09F 15/00 40/610
2008/0164232 A1 * 7/2008 Smith ..... F16M 11/041 211/87.01
2010/0122777 A1 5/2010 Gutierrez
2011/0253183 A1 10/2011 Mowatt
2012/0193036 A1 8/2012 Lamotte
2013/0187018 A1 * 7/2013 Canfield ..... G09F 17/00 248/219.4
2016/0102473 A1 4/2016 Ma
2017/0298693 A1 * 10/2017 Graham, Sr. ..... E06C 7/188

OTHER PUBLICATIONS

SunCoast Awning, Fixed Awnings—Materials, http://suncoastawning.com/products-services_page.php?id=18&keywords=Materials, known at least as early as Sep. 16, 2015, last viewed Dec. 11, 2015, 2 pgs.

* cited by examiner

BUILDING-MOUNTED AWNING WITH SINGLE LOCATION ATTACHMENT

PRIORITY

This application is a continuation of prior application Ser. No. 14/856,900 filed Sep. 17, 2015, the contents of which are hereby incorporated by reference.

FIELD OF DISCLOSURE

The present disclosure relates to awnings, canopies, and other sunshades. Particularly, the present disclosure relates to awnings, canopies, and sunshades that are attached to buildings, for example commercial buildings, to provide protection from weather, provide pleasing architectural aesthetics, or for use in displaying signage or other advertising.

BACKGROUND

Awnings are in-use around the world. Awnings enhance the appearance of many buildings, provide shade or cover from precipitation and wind, and can be a useful medium on which to provide advertising or signage for businesses. Awnings are generally constructed from a fabric or similar web of material supported by a frame. Awnings are traditionally affixed to a building and form a permanent fixture, often in-use above windows or doors. In many cases, the frames of existing awnings are generally cantilevered from buildings with attachment points running along the substantial width of the awning, or cantilevered by using two or more spaced apart points of attachment, generally adjacent to each end of the awning.

Inventors have determined that there is a need for awnings and canopies that can be more quickly and easily attached and detached from a building so that the awning can be more easily changed or removed to adapt to weather conditions, or adapt to desired changes in appearance and content.

SUMMARY

In one embodiment, the present disclosure includes a building-mounted awning. The awning may comprise a support frame and a covering. The covering may be provided over the support frame to act as shelter from precipitation or act as a shade from the sun. The support frame may be attached to the building at only one location along a width of the support frame.

In another embodiment, this disclosure includes a building-mounted awning system comprising a bracket substantially permanently attached to a building, an awning support frame, and a covering provided over the awning support frame. The awning support frame is attached to the building by the bracket with a quick-connect attachment.

A method is also described. The method may include mounting a single bracket to an exterior wall of a building and attaching an awning to the single bracket such that the bracket attaches to only one location along a width of the awning.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
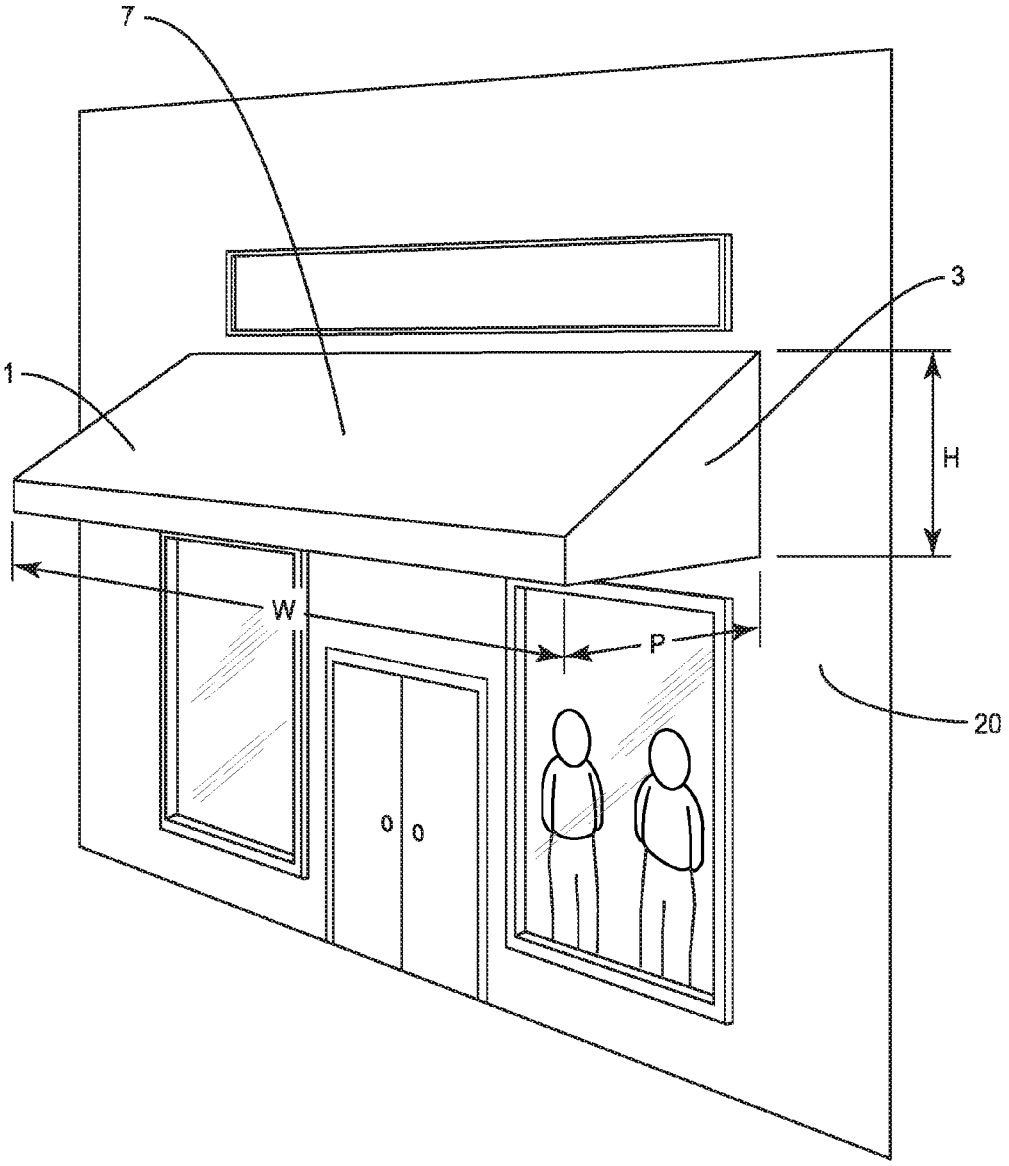
FIG. 1 is a view of a representative awning attached to a building.

The present disclosure relates to awnings 1. A representative awning 1, attached to a building 20, is shown in FIG. 1. Other terms for awnings include "canopies" and "sunshades." As used herein, the term "awning" should be interpreted in view of its plain meaning. For example, the online edition of Merriam-Webster's dictionary, found at Merriam-Webster.com (last accessed Aug. 18, 2015), defines "awning" as "a roof-like cover extending over or in front of a place (as over the deck or in front of a door or window) as a shelter," as of the filing of the present application.

As used herein, the "width" (see "W" in FIG. 1) is understood as a dimension along a substantially horizontal line extending along a building on which the awning 1 is attached. The height or drop (see "H" in FIG. 1) of an awning is the dimension along a substantially vertical line extending along a building on which the awning is attached. The "projection" (see "P" in FIG. 1) of the awning is the dimension extending perpendicular to the wall of the building.

The present disclosure relates to awnings 1 for use on buildings 20. The awnings 1 may span a range of widths from about 2 feet to about 30 feet. The awnings 1 may span a range of projection sizes from about 2 feet to about 10 feet. The awnings 1 may be provided in a range of profiles and styles, including a variety of shapes and slopes of the top thereof. Example configurations include straight slope (as seen in FIG. 1), convex, concave, casement, circular, domed, gable, etc. The embodiment of FIG. 1 includes side panels 3, which may or may not be included.

Figure 2:
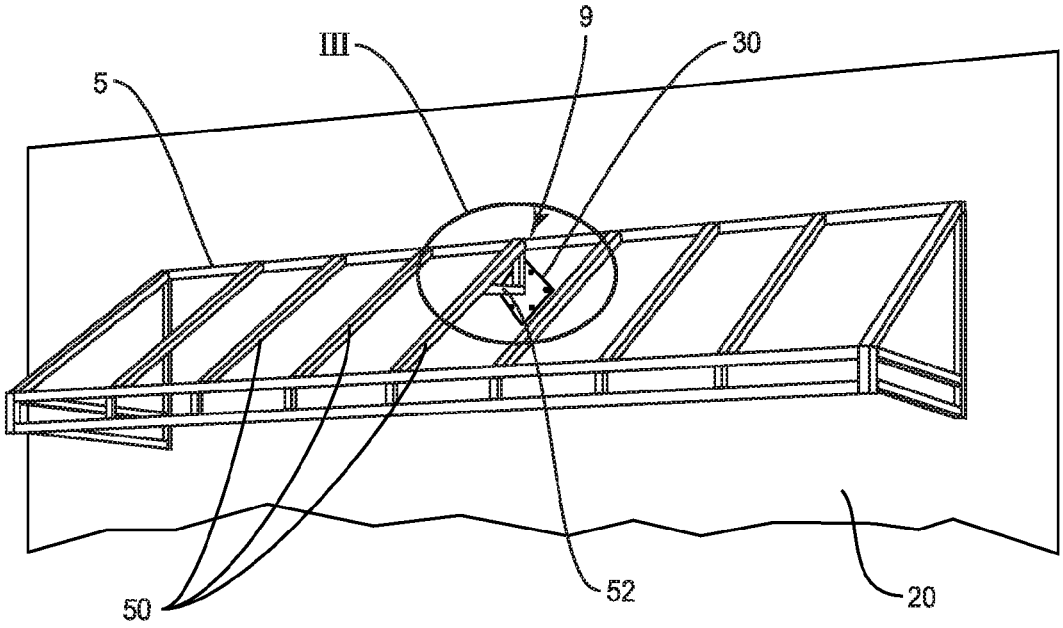
FIG. 2 is a view of the awning of FIG. 1 with the covering removed.

The awnings 1 of the present disclosure generally include a support frame 5 (see FIG. 2) and a covering 7 provided over the support frame 5 to act as shelter from precipitation or wind, or act as a shade from the sun. As shown in FIG. 2, the support frame 5 may be provided by rigid tubing or other structural members 50. The structural members 50 may be constructed from aluminum for its combination of strength, cost, availability, and relative light weight. The particular configuration and arrangement of structural members 50 constructing the support frame 5 will vary based upon the finished shape of the awning 1. In the illustrated embodiment, the support frame 5 was constructed of aluminum tubing that was 2 inches square, 2 inches by 1 inch, and 1 inch square for various portions of the support frame 5. Those portions of the support frame 5 nearest a mounting point 9 may comprise the largest profile structural members 50. The tubing thickness of the structural members 50 in one tested example ranged from about 0.188 inches thick down to about 0.093 inches thick. Again, the larger profile tubes had larger wall thicknesses. The size, shape, and thickness of the structural members 50 of the support frame 5 may vary based on the size of the finished awning 1, such that larger awnings may require stronger structural members 50.

Returning to FIG. 1, the material selected for the covering 7 of the awning 1 may vary. The covering 7 may be fabric, canvas, plastic webbing (as in a tarp), plastic or metal sheeting, or glass panels. The covering 7 may act as a roof providing shelter from the precipitation. The covering 7 may be used to provide shade if produced by an opaque or semi-transparent material. If a fabric is used for the covering 7, a waterproof layer may be included to increase protection from precipitation. An example of a suitable covering may be Sunbrella® fabrics from Glen Raven.

In some embodiments, the awnings 1 of the present disclosure are configured to attach, or are attached, to a building 20 at a mounting point 9 representing only one location along the width W of the awning 1. As used herein, the term "one location along the width" excludes separate points of attachment substantially spaced apart relative to the overall width of the awning. Further "one location along the width" excludes a continuous or substantially continuous line of attached locations along at least a majority of the width of the awning. Having "one location" of attachment "along the width" does include two or more distinct points of attachment that are so compact in their spacing along the width direction relative to the overall width of the awning that one skilled in the art would reasonably model the anticipated performance of the attachment points as a single point. For example, two or more points may be spaced apart with the distance between the furthest most attachment points being less than about 10%, less than about 5% or less than about 1% of the total width W of the awning 1 to still qualify as "one location along the width." The attachment points may be located on the same or separate brackets attached to the building. Two or more closely spaced attachment points may help minimize twisting motion of the awning 1.

In some embodiments, the awnings 1 of the present disclosure are configured to attach, or are attached, to a building 20 at a mounting point 9 representing only one location along the height H of the awning 1. As used herein, the term "one location along the height" excludes separate points of attachment substantially spaced apart relative to the overall height of the awning. Further "one location along the height" excludes a continuous or substantially continuous line of attached locations along at least a majority of the height of the awning. Having "one location" of attachment "along the height" does include two or more distinct points of attachment that are so compact in their spacing along the height direction relative to the overall height of the awning that one skilled in the art would reasonably model the anticipated performance of the attachment points as a single point. For example, two or more points may be spaced apart with the distance between the furthest most attachment points being less than about 10%, less than about 5% or less than about 1% of the total height H of the awning 1 to still qualify as "one location along the height." The attachment points may be located on the same or separate brackets attached to the building. Two or more closely spaced attachment points may help minimize twisting motion of the awning 1. In several embodiments, the awnings 1 will have both attachment at "one location along the width" and attachment at "one location along the height" to result in attachment at substantially a single point.

By providing an awning 1 attached at a single location, and possibly a single point, the awnings 1 of the present disclosure can be more quickly and easily attached to and detached from the building 20. Awnings attached in this manner can be more easily changed or removed to adapt to weather conditions, or adapt to desired changes in appearance and advertising content displayed thereon.

Figure 4:
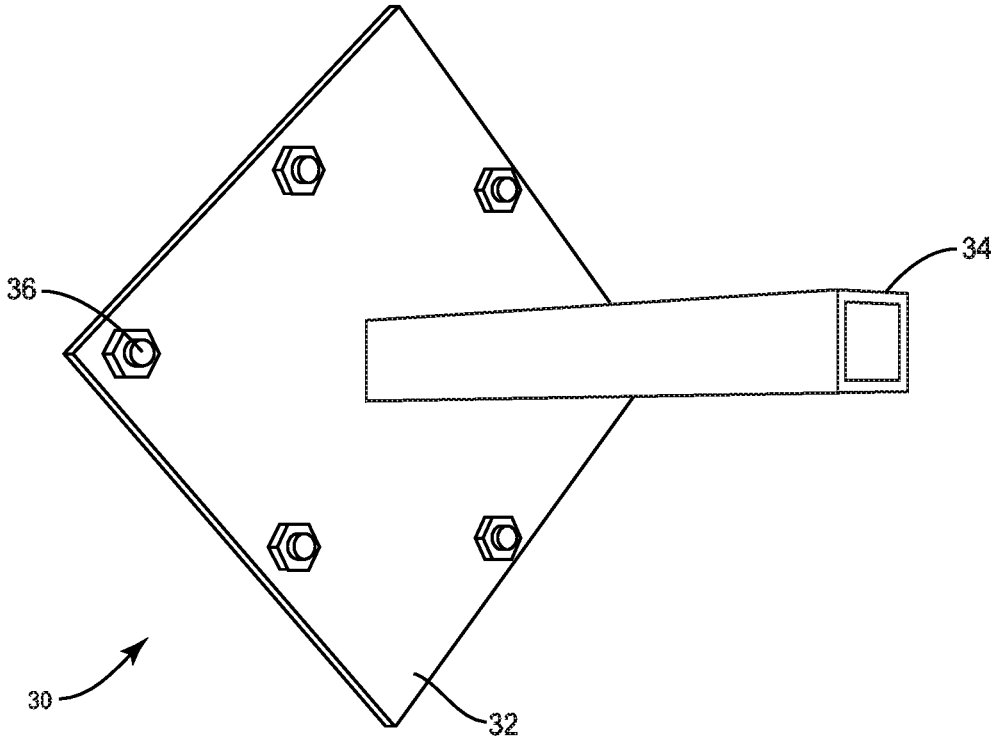
FIG. 4 is a detailed view of a bracket 30 for being fixed to the building of FIG. 1 and to support the awning of FIG. 1.

To provide attachment between the building 20 and the awning 1, one or more brackets 30 may be mounted to a wall of the building 20. An example of a suitable bracket 30 is shown in FIGS. 2 and 4. The bracket 30 may be a single bracket to facilitate attachment of the awning 1 to the building 20 at only one location along the width and height of the awning 1, i.e., at one mounting point 9. The bracket 30 may comprise a wall plate 32 and an attachment post 34. One or more fasteners 36 may be used to mount the wall plate 32 to the building 20 in a secure, substantially permanent manner. The size, style, and quantity of fasteners 36 may vary depending upon the construction of the building wall, the size and configuration of the awning 1, and the desired strength of the system. In one example, the wall plate 32 can be about one-half inches thick and may be secured to a brick or concrete wall with six concrete anchors. The fasteners 36 may have a ½-inch diameter anchors with a 2.5 inch length. The fasteners 36 may or may not be adhered to the building 20 and the wall plate 32 with epoxy.

In the illustrated embodiment, the bracket 30 comprises an attachment post 34 configured to protrude from the building and the wall plate 32. The attachment post 34 may be welded to the wall plate 32. The post 34 may be constructed for tubular aluminum, such as about 1.5 inches square with a wall thickness of about 0.188 inches. The post 34 is not necessarily rectangular but could be round, triangular, etc. A round post may be less preferred because a round shape may be less able to resist torque around a longitudinal projection axis of the post 34. The post 34 may project several inches from the building. The post 34 may have a projection that is as long as possible without interfering with the pitch of the awning 1. For example, the projection of the post 34 may be between about 6" and about 24". A post 34 that is too short may not provide sufficient support strength. A post 34 that is too long may interfere with the profile of the awning or increase the difficulty of installation if the post 34 and the support frame 5 must be initially aligned too far from the building's wall.

Figure 3:
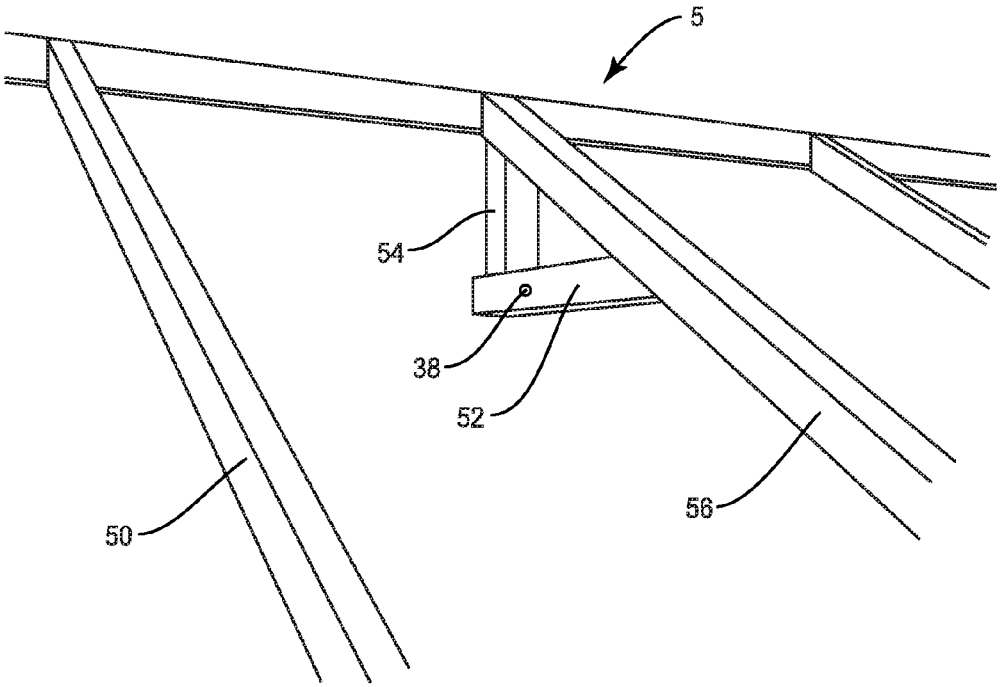
FIG. 3 is a detailed view of a portion of the awning's support frame shown in FIG. 1.

In certain embodiments, as seen in FIG. 3, one of the structural members 50 of the support frame 5 may be a receiver 52. In several embodiments, the receiver 52 can be centrally located within at least one of the width direction and the height direction of the awning 1. The receiver 52 may be constructed to be the same profile and gauge as the remainder of the structural members 50. In other embodiments, the receiver 52 may be constructed as one of, or the, most robust of the structural members 50. The receiver 52 may be configured for attachment to the bracket 30. The attachment may include having the receiver 52 slide over or into the post 34. In the illustrated embodiment, the receiver 52 may constitute a sleeve capable of being slid over the post 34.

As shown in FIGS. 2 and 3, the receiver 52 can be positioned generally horizontally when the awning 1 is attached to the building 20. Another structural member 50 of the support frame 5 may form a stanchion 54 extending upwardly from an inward end of the receiver 52 to help strengthen the receiver 52 relative to the support frame 5 as a whole. A rafter 56 may connect a top of the stanchion 54 to an exterior end of the receiver 52. The rafter 56 can extend beyond the exterior end of the receiver 52 to an extent that the rafter 56 substantially defines a degree of overhang and the projection dimension of the awning 1 away from the building 20. The rafter 56 may have a larger diameter and thicker gauge than other structural members 50 running parallel to the rafter 56.

In some embodiments, awnings 1 of the present disclosure are attached to the building 20 by a quick connect attachment. Use of a quick connect attachment allows the awnings 1 to be more readily installed and uninstalled when weather conditions warrant, such as tropical storms, or simply when it is time to change the appearance or content of the covering 7. As used herein, quick connect attachments occur when the awning 1 has a single mounting point 9 as discussed above, but not all single mounting point awnings have quick connect attachments.

As used herein, a quick connect attachment includes, among others:

- the use of one or more pin 38 (see FIG. 3) to fix the receiver 52 to the post 34;
- connections with the ability to disconnect respective elements by hand without the use of tools, such as wing nuts or thumbscrews;
- connections with the ability to disconnect the awning 1 from the wall by releasing only a single connector;
- magnetic locking attachment mechanisms;
- nuts and bolts;
- set screws;
- latches, such as for tool boxes;
- ratchets;
- hitch pins with cotter pins or the like;
- quick release mechanical fasteners;
- quarter-turn fasteners;
- quick disconnects such as for hose lines; and
- resilient detents/push button locking pins.

Quick connect attachment excludes:

- pop rivets;
- welds; and
- machine screws.

A method of installing the awning 1 should also be understood from the example embodiments discussed above. For example, an installation method may comprise mounting a single bracket 30 to an exterior wall of a building 20 and attaching an awning 1 to the single bracket 30 such that the bracket attaches to only one mounting point 9 along a width of the awning.

In certain embodiments where the bracket 30 comprises a post 34 arranged to protrude from the building 20, the step of attaching the awning may further include sliding a portion of a support frame 5 of the awning into or over the post 34. Then, the step of attaching the awning may include passing a pin 38 through the portion of the support frame and the post, to fix the awning to the building.

In some embodiments, the support frame 5 or the bracket 30 may be adapted to allow the awning 1 to be hung with variable pitch relative to the wall of the building 20. In some embodiments, the connection between the bracket 30 and the receiver 52 may be improved by providing silicone, rubber, or other damping material between the attached elements to minimize noise and rattle of the awning at the attachment location. Similar soft rubber-like materials may be provided along an interior edge of the awning positioned to face the building 20 to minimize noise and rattle that could be caused by the unsecured portions of the awning 1 striking the wall of the building 20. Additionally, the rubber-like material may act as a gasket to form a partial seal and help minimize water leaking between the building 20 and the awning 1. In one example the attachment between the awning 1 and the building 20 uses a latch designed such that closing the latch may pull the interior edge of the awning toward the wall of the building, compressing the gasket to increase the sealing and dampening between the wall and the awning.

The present disclosure is not limited to the specific design of the support frame 5 and bracket 30 illustrated but includes all similar single point, and quick connect attachments. In some embodiments, round tubing may be preferred. In some embodiments the connection between the awning 1 and a wall bracket 30 may be in the form of a ball and socket connector.

The awnings 1 may be used for advertising or decoration that would benefit from periodic, seasonal, or even occasional replacement, such as the announcement of a temporary sale occurring within a store. A kit may be provided having a plurality of awnings 1 or a plurality of coverings 7 to facilitate common chances. The kit may be described in terms of the following paragraph:

Paragraph A: A kit comprising:

- a single bracket configured to substantially permanent attachment to a building;
- at least one support frame attachable to the single bracket at a single location; and
- a plurality of coverings to be selectively applied over the at least one support frame, each covering having a unique appearance.

Paragraph B: The kit of paragraph A, comprising a plurality of support frames equal to or less than the quantity of the plurality of coverings.

Use of the kit, or a plurality of awnings 1, or a plurality of coverings 7, may facilitate a method of advertising described in terms of the following paragraphs:

Paragraph C: An advertising method, comprising:

- installing an awning onto a building, the step of installing the awning comprising:
  - mounting a single bracket to the building; and
  - mounting the awning to the single bracket, the awning having a support frame and a covering, the covering containing advertising; and
- changing the advertising by removing the awning from the single bracket without removing the single bracket from the wall, and one of:
  - a) mounting a second awning to the single bracket; or
  - b) removing the covering of the awning from the support frame, applying a second covering over the support frame having a different advertisement, and remounting the awning to the single bracket.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A building-mounted awning system, comprising:

a support frame;

a covering provided over the support frame to act as shelter from precipitation or act as a shade from the sun; and a single bracket secured to a wall of a building, the single bracket having a post, wherein a longitudinal axis of the post extends in a direction away from the wall of the building, wherein the support frame is fixedly secured to the single bracket, wherein the support frame is secured to the single bracket at only one location along a width of the support frame to support the support frame relative to the wall, wherein the support frame is not supported by any other structure attached to the wall, wherein moving the support frame along the post in a direction toward the wall of the building secures the support frame to the post, so as to avoid interference with any adjacent structure protruding from the wall of the building.

2. The awning system of claim 1, wherein the support frame is attached to the single bracket at only one location along a height of the support frame.

3. The awning system of claim 1, wherein a portion of the support frame slides over or into the single bracket.

4. The awning system of claim 3, wherein a single pin or bolt fixedly secures the portion of the support frame with the single bracket.

5. The awning system of claim 4, wherein the portion of the support frame is a central portion of the support frame along the width.

6. The awning system of claim 3, wherein the single bracket comprises a post protruding from the building and the support frame includes a sleeve slid over the post.

7. The awning system of claim 6, wherein the support frame includes the sleeve positioned generally horizontally when the support frame is attached to the building, a stanchion extending upwardly from an inward end of the sleeve, and a rafter connecting a top of the stanchion to an exterior end of the sleeve.

8. The awning system of claim 7, wherein the rafter extends beyond the exterior end of the sleeve to an extent that the rafter substantially defines a degree of overhang of the awning system away from the building.

9. The awning system of claim 1, wherein the support frame is fixedly secured to the single bracket with a tool-free quick connect attachment.

10. A building-mounted awning system, comprising:

a bracket substantially permanently attached to a wall of a building;

an awning support frame; and a covering provided over the awning support frame, wherein the bracket has a post, wherein a longitudinal axis of the post extends in a direction away from the wall of the building, wherein moving the awning support frame along the post in a direction toward the wall of the building attaches the awning support frame to the post to support the awning support frame relative to the wall, after the bracket is attached to the wall, so as to avoid interference with any adjacent structure protruding from the wall of the building, wherein the awning support frame is securely fixed to the post with a quick-connect attachment, and wherein the awning support frame is not supported by any other structure attached to the wall.

11. The awning system of claim 10, wherein the awning support frame is attached to the building by only one quick connect attachment at only one location along a width of the awning support frame.

12. The awning system of claim 11, wherein the awning support frame includes a sleeve slid over the post.

13. The awning system of claim 12, wherein the awning support frame includes the sleeve positioned generally horizontally when the awning is attached to the building, a stanchion extending upwardly from an inward end of the sleeve, and a rafter connecting a top of the stanchion to an exterior end of the sleeve.

14. The awning system of claim 13, wherein the rafter extends beyond the exterior end of the sleeve to an extent that the rafter substantially defines a degree of overhang of the awning away from the building.

15. The awning system of claim 11, wherein the awning support frame includes a receiver slid into the post.

16. The system of claim 11, wherein the awning support frame is attached to the building by only one quick connect attachment at only one location along a height of the awning support frame.

17. The system of claim 10, wherein the quick-connect attachment comprises a single pin or bolt.

18. A method, comprising:

mounting one and only one bracket to an exterior wall of a building, wherein the bracket has a post, a longitudinal axis of the post extending in a direction away from the exterior wall of the building;

attaching an awning support frame, having a cover, to the bracket such that the bracket attaches to only one location along a width of the awning support frame wherein the support frame is not supported by any other structure attached to the wall; and securely fixing the awning support frame to the post with a quick-connect attachment;

wherein attaching the awning support frame to the single bracket comprises attaching the awning support frame to the post by moving the awning support frame along the post in a direction toward the exterior wall of the building after the bracket is mounted to the wall so as to avoid interference with any adjacent structure protruding from the wall of the building.

19. The method of claim 18, wherein the step of attaching further comprises:

sliding a portion of the awning support frame into or over the post.

20. The method of claim 19, wherein the step of securely fixing comprises passing a pin through the portion of the awning support frame and the post.

* * * * *